US007735945B1

(12) United States Patent
Sliwa, Jr. et al.

(10) Patent No.: US 7,735,945 B1
(45) Date of Patent: Jun. 15, 2010

(54) MICROBUBBLE AND MICRODROPLET SWITCHING, MANIPULATION AND MODULATION OF ACOUSTIC, ELECTROMAGNETIC AND ELECTRICAL WAVES, ENERGIES AND POTENTIALS

(76) Inventors: John W. Sliwa, Jr., 897 Madonna Way, Los Altos, CA (US) 94024; Carol A. Tosaya, 897 Madonna Way, Los Altos, CA (US) 94024

( * ) Notice: Subject to any disclaimer, the term of this patent is extended or adjusted under 35 U.S.C. 154(b) by 1555 days.

(21) Appl. No.: 11/035,488

(22) Filed: Jan. 13, 2005

Related U.S. Application Data

(60) Provisional application No. 60/536,025, filed on Jan. 13, 2004.

(51) Int. Cl.

| | |
|---|---|
| *B41J 29/38* | (2006.01) |
| *B41J 2/015* | (2006.01) |
| *B41J 2/04* | (2006.01) |
| *B41J 2/045* | (2006.01) |
| *B41J 2/02* | (2006.01) |

(52) U.S. Cl. ..... 347/6; 347/14; 347/20; 347/54; 347/68; 347/73

(58) Field of Classification Search ..... 347/20, 347/6, 14, 54, 68, 73

See application file for complete search history.

*Primary Examiner*—Shih-wen Hsieh

(57) ABSTRACT

The formation and manipulation of microbubbles, microdroplets and films of (preferably) flowable materials, such as liquids and gases, are used to beneficially control or modulate acoustic-energy propagation, electromagnetic-energy propagation or electrical potential and current application. A droplet, bubble or film causes at least one of reflection, refraction, diffraction, attenuation, sapping, scattering, dissipation, redirection, conversion or blocking of at least one component of the energy due to the droplet, bubble or film causing a propagation discontinuity, disruption or energy-barrier to the energy. The energy comprises at least one of acoustic, electrical, electromagnetic, magnetic, kinetic, mechanical, chemical, RF, thermal, pneumatic, hydraulic or non-visible optical energy.

63 Claims, 2 Drawing Sheets

FIG. 4A
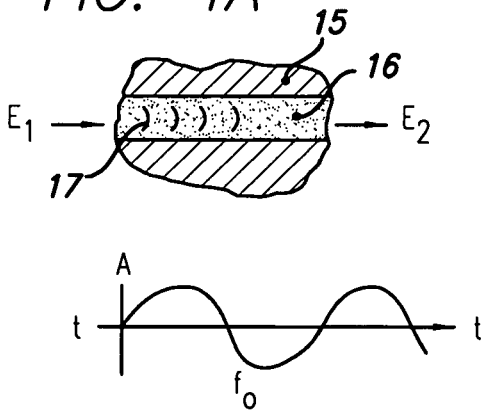
FIG. 4B
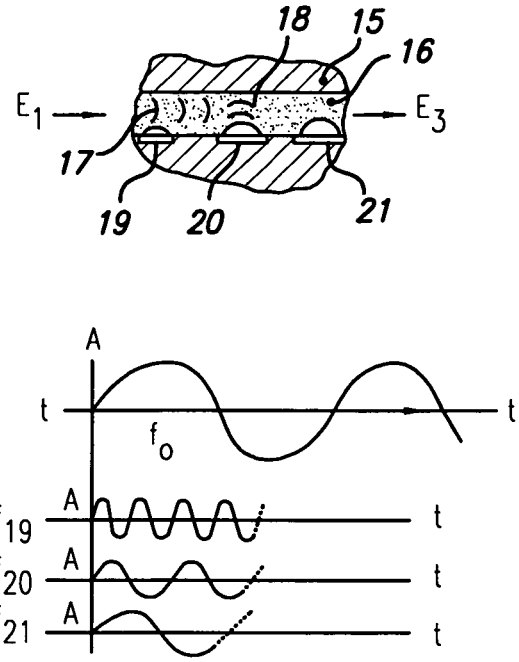
FIG. 5A
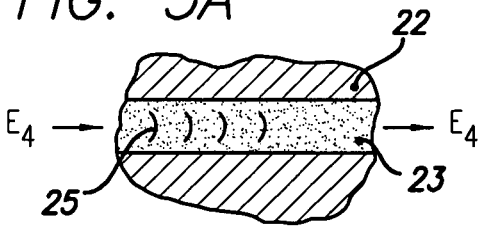
FIG. 5B
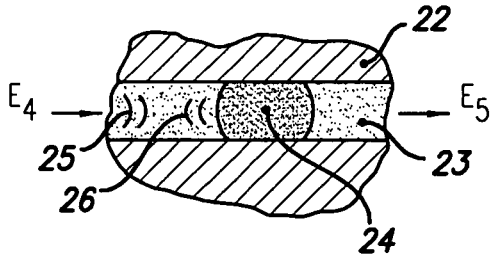
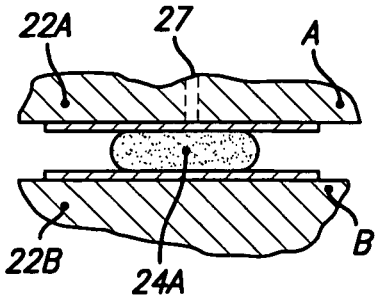
FIG. 6

MICROBUBBLE AND MICRODROPLET SWITCHING, MANIPULATION AND MODULATION OF ACOUSTIC, ELECTROMAGNETIC AND ELECTRICAL WAVES, ENERGIES AND POTENTIALS

CROSS-REFERENCE TO RELATED APPLICATION

The present application claims priority from provisional application Ser. No. 60/536,025, filed Jan. 13, 2004.

FIELD OF THE INVENTION

The present invention is in the field of switching, manipulating or modulating acoustic, electromagnetic, and electrical waves, energies, and potentials inexpensively, and optionally, on a highly integrated microscopic scale. All forms of such energies except visible optical-energy or visible optical-energy components are included.

BACKGROUND OF THE INVENTION

Acoustic energy is increasingly utilized, directly or indirectly, in a large number of fields, including medical ultrasound diagnostic imaging, thermal bubble-jet inkjet personal printers, piezo-jet inkjet personal printers, non-destructive testing, sonar, and microphone technologies, to name a few. Distance sensors, mass-sensors, fluid-level sensors, and many security sensors also incorporate acoustic and ultrasonic devices. Emerging applications include the use of ultrasound to manipulate fluids or analyze samples on a microscopic scale within lab-on-a-chip devices. All of these involve the controlled application, passage or manipulation of acoustic waves created in a variety of manners.

Of substantial value would be the ability to switch, redirect or modulate the propagation of acoustic waves at low cost and on a fine scale amenable to micro-integration. This would allow reconfiguration of acoustic-based systems and components in a rapid dynamic manner on a grand scale, perhaps even in real time. This is not currently possible at low cost or on a fine scale. The acoustic waves we will manipulate are typically traveling in some sort of acoustic material or waveguide, such as in a gas-filled waveguide, liquid-filled waveguide, solid waveguide or in a substrate having technically useful acoustic or electroacoustic properties, such as lithium niobate. In any event, all such waves can be manipulated in accordance with the teachings of the invention in at least one of its embodiments. We also note that acoustic waves can take many forms such as bulk waves and surface waves of various well-known types, and the teachings of the present invention can be applied to one or more of these types separately or even simultaneously.

Likewise, RF (radio-frequency) energy and other high frequency electromagnetic waveforms are increasingly being employed in communications, radar, tracking devices, GPS (geopositioning systems), and in recent efforts to utilize terahertz electromagnetic energy to do medical diagnostic imaging and airport security screening. A similar means of inexpensively switching, modulating or redirecting such energies cheaply, and particularly on a fine scale, would be attractive. Potential applications include reconfigurable antennas, power-efficient personal communication devices, miniature security scanners, and self-healing electronic systems.

It would also be attractive to have a means of modulating electrical currents passing-through or potentials applied-to conductive-liquid microfluidic channels. Conductive liquids through which some electrical current flows, for example, are used in some continuous inkjet printers.

In these manners, one could implement networks or arrays of acoustic, electromagnetic or electrical-energy propagation switching, redirection and modulation devices using coplanar IC-style integration or other MEMs-like techniques in two- or three-dimensions. This would particularly have a large impact on what is possible in a consumer or mobile product. For RF devices, the present invention is seen as providing an additional tool with which to manipulate RF beyond existing FET switches and PIN diodes.

One prior art reference that we identified that may be relevant is "Switching Fiber-Optic Circuits with Microbubbles" by John Uebbing, appearing in *Sensor Magazine* in May 2003. In short, Uebbing utilizes thermally-formed microbubbles, such as the type employed in inkjet printing technology, to block or allow the propagation of light used in fiber-optic data lines-in the form of a bubble-based light switch. The bubbling-switch of their article is provided as a MEMS-based or micromachined bubble-array switch to compete with Texas Instruments DLMs™ or digital light mirrors, which are also useable as switch arrays for fiber-optic signals. Advantages are very high switching density at very low cost. As will be shown below, however, this reference is fundamentally different from our claimed invention.

SUMMARY OF THE INVENTION

We utilize the formation and manipulation of microbubbles or microdroplets of (preferably) flowable materials, such as liquids and gases, to beneficially control, redirect or modulate acoustic-energy propagation, electromagnetic-energy propagation or electrical potential and current application.

By "acoustic energy", we mean any acoustic energy having an order of magnitude frequency between a milliHertz and several gigahertz or even terahertz. By "electromagnetic propagation", we mean the passage or application of any electromagnetic energy, voltage or current other than visible optical electromagnetic energy. Such would include RF radiofrequency energies in the megahertz, gigahertz and terahertz ranges, direct currents (DC), alternating currents (AC), and applied electrical potentials (voltages) even with no current flowing. Thus, on the electromagnetic side, we are talking about everything from DC static potentials all the way up to but not including visible optical frequencies and above such visible optical frequencies. The reader will also be aware that certain electromagnetic signals can be polarized, such as in radar gigahertz-range systems, and we include all such signals having such polarizations in the scope. We note that the X-ray and gamma-ray ranges of electromagnetic energy are also covered as they are above the visible optical range.

In fundamentally different fields, applications, and realms of energy, we recognized that microbubbles, for example, could also be used to switch the propagation of (or application of) acoustic energy, electromagnetic energy or potential such as RF and DC/AC electrical power and potential. The reader will realize that to do this, different kinds of energies or potentials require different properties of the fluid (or bubble) to be manipulated. For example, for acoustic microswitching, the acoustical impedance and acoustic attenuation of the fluid/bubble are important, whereas these are not important for the referenced prior art visible optical energy microswitching. Thus, it clearly is not obvious to apply prior art optical microswitching to these alternative energies, which have different behavior and require different physical parameters be manipulated. In fact, it is not only the switching physics that is different, but the energy waveguides involved are also of known fundamentally different design.

Beginning with acoustic energy as an example, a lab-on-a-chip could utilize acoustics to at least one of pump or stir microvolumes of fluid reagents as by acoustic streaming or could utilize acoustics to spectrally analyze the composition or structure of solutions or mixture-specimens in such a chip. The existence of a vapor bubble, as formed by an in-situ heater in a microfluidic channel for example, would cause the propagating acoustic energy in the channel liquid to be blocked, reflected or redirected depending on the bubble geometry. This is because of the huge difference in acoustic impedance (and attenuation) between the liquid and the vapor. Further, the removal of a bridging liquid droplet could cause an open-circuit for acoustics traveling from one liquid or solid material to another. Acoustics is defined herein as infrasonic, sonic or ultrasonic energy, thereby possibly having frequency content from (orders of magnitude) 1 millihertz to 1 or more terahertz. We explicitly note that the energy to be switched, redirected or modulated, in accordance with the invention, need only interact with one of our inventive microbubbles or microdroplets. It does not require that the energy be delivered to and from that interaction site as by a waveguide, although a waveguide suitable for that energy will most commonly be employed. Thus, we see applications wherein microdroplets allow for bridging of an energy, perhaps acoustic energy, from one member or surface to another, possibly without any waveguides being involved.

Thus, we recognized that, depending on what media the acoustics is propagating within, the placement or removal of a vapor-bubble or liquid-droplet could serve to provide switching or modulation of the acoustic signals. There are any number of means of doing this such as by, but not limited to: a) forming a bubble in a liquid path, b) placing a remotely formed bubble into a liquid path, c) forming a droplet in a gap in an otherwise solid path, d) remotely forming a droplet and placing it in a gap in an otherwise solid path, or e) bridging between two surfaces via the interposing of a flowable material which can be selectively bridged via droplet or film formation or unbridged as by bubbling or film drainage or dewetting. Thus, our "microdroplets: and "microbubbles" in some cases may be large enough that they constitute films or layers typically but not necessarily having at least one macroscopic dimension.

We also note that by only partially blocking the path with a smaller bubble or droplet, for example, we can modulate the passing acoustics in amplitude to values between 100% and 0%. Acoustic practitioners will also recognize that by placing microbubbles in the acoustic path, say along a fluid-filled microchannel, that these bubbles change the acoustic behavior of the system. For example, if one has one or more spaced bubbles in the channel and they only partially span the width of the microfluidic channel, then they will modulate the passing acoustics because of their blocking/filtering properties and will also introduce new bubble resonances into the acoustic output. Thus, such bubble arrays can also be employed to favorably introduce or tune-in new spectral features as a function of how they change the resonant properties of the microfluidic system. Similarly, such bubbles can act as filters for particular frequencies at their resonance values. The acoustical behavior of bubbles and droplets has long been of scientific interest for ultrasonic-cleaning and related cavitating applications. We explicitly note that properties other than amplitude can also or instead be manipulated with our invention. For example, phase and polarization of RF and acoustic signals can be manipulated in known manners upon interaction with a bubble or droplet.

Practitioners of the acoustic arts are aware that the ability of a bubble to totally block acoustic propagation is primarily related to its high acoustic reflection coefficient due to the abrupt change in acoustic impedance traveling from fluid to the vapor (or gas) bubble. For an intermediate example, if one were to place a liquid microdroplet of a second foreign liquid in a first liquid, then, as long as there is some finite acoustic impedance difference between the two fluids, there will be some reflection and some transmission of the energy at the interspersed bubble as predicted by the impedance-derived reflection coefficients. Thus, interposed microdroplets of liquid (as opposed to vapor or gas) placed within a fluid waveguide can also modify or modulate acoustic propagation, albeit typically to a much lesser degree than a gas bubble in a liquid waveguide. Such microdroplets could also be introduced into the propagation path from a remote location outside of the waveguide itself, assuming a waveguide is employed.

Given the basic acoustic-microswitching concept, an acoustics practitioner will realize that the present invention can also be used to modify the surface of acoustic components such as acoustic mirrors and acoustic lenses such that the surfaces perform the switching or modulation functions described. For example, a metal acoustic-mirror can be modified by creating an array of microbubbles or microdroplets on its surface. These microbubbles or microdroplets will have numerous effects including selective diffractive and reflective cooperative or summed effects that are a predictable function of their spatial arrangement. Such switchable microbubbles or microdroplets will also allow the controlled introduction of phase-changes at such newly modified reflective surfaces. Preferably, microbubbles would be formed by in-situ heaters on fluid immersed (or coated) acoustic components whereas microdroplets would, for example, be condensed upon air or vapor-immersed acoustic components. Thus, something that looks like an acoustic mirror could have bubbles or droplets introduced in an array on (or in) its surface such that the "mirror" now serves also or instead to selectively redirect acoustic beams in certain desired diffraction directions determined by the bubble pattern and bubble size relative to the incoming acoustic wavelength.

Thus, it is possible to switch, redirect or modulate energy over a large region using one or more microdroplets, microbubbles, microfilms or assemblages thereof, including assemblages wherein individual microbubbles/droplets have or are combined into continuous films of flowable material such as gas or liquid. Note that our microbubbles or microdroplets are not necessarily spherical or roughly polyhedral when they are attached to surfaces. They can also be of extended dimension such as a very long bubble in a channel (waveguide) whose length is perhaps 10 or even 100 times its diameter (or cross-section). In many cases, the microdroplets or microbubbles will take the shape of their surroundings. As an example, a bubble grown in a square cross-section extended channel will have flattened surfaces that contact the channel walls but will have other curved surfaces facing the liquid. Depending on the energy or wavelength being manipulated, one may favorably choose the microbubble or microdroplet to favorably have at least one dimension which is a known multiple (or fraction) of that wavelength. As an example, an acoustic-manipulation droplet might be chosen such that its propagation-direction depth is a quarter wavelength of the acoustical energy such that it serves as an acoustic matching medium. Likewise, a droplet serving to block RF or electromagnetic energy could be chosen such that the incoming RF signal is attenuated within a known extinction range or reflected within a known reflection thickness of a droplet media. The "skin" effects of RF energy are well-known. Those familiar with switching RF will realize that physical parameters of the switching liquid such as dielectric constant, electrical conductivity, tan-delta (lossiness), and attenuation can be varied to achieve these purposes.

Thus, the scope of the invention includes the insertion into a path of acoustic propagation microbubbles, microdroplets or even extended microfilms of flow-able or vaporous materials which beneficially switch or modulate such acoustics or which allow modification of the acoustic behavior of the system due to the microbubbles etc. being new resonating or otherwise-deforming constituents of the system. In cases wherein such microbubbles or microdroplets appear in an array, one may also derive useful diffractive effects along particular angles of incidence. A blanket illuminating incoming acoustic beam could be purposely diffracted in predictable directions, including multiple simultaneous directions, by the known diffraction effects of arrayed scatterers. This could be useful for beam scanning and steering.

In the field of electromagnetic energy switching and manipulation, it is known, for example, that high frequency RF, as used in radar and the newly found field of terahertz medical diagnostic imaging, is reflected from surfaces which have a dielectric constant discontinuity and project a surface area onto the oncoming wave (have a reflective cross-section). Thus, if one has a gas- or vapor-filled waveguide for such energy and one interposes a droplet or body of conductive fluid in its path, one would know that one can reflect a portion of that energy, thereby providing a switch or modulator of that energy. Likewise, if the droplet is RF-dissipative, it can act as a modulator or attenuator and allow some energy to pass through it, depending on its thickness, dielectric constant, and losses. Since microscopic bubble and droplet making and moving techniques can be utilized to do this, it is possible to now manipulate electromagnetic energy propagation at a fine scale in a highly integrated manner. Note that one could also use a bubble, for example, to disrupt electrical current-flow or the application or electrical-potential through an electrically conductive liquid flowing (or sitting statically) in an electrically-insulating channel. In that case, one would simply break the conductive-liquid circuit with the electrically-insulating vapor bubble (or, alternately, with an electrically-insulating droplet). Included in the scope of the invention is the employment of semiconducting droplets and microbubbles that could allow for the formation of active electronic components such as diodes and transistors. These are, after all, modulators and switchers also.

The prior art field of RF signal-manipulation heavily utilizes PIN diodes and FET switches to switch and modulate RF signals. Recently, it has been shown that MEMs-based switches offer benefits over that prior art. In particular, it has been demonstrated that capacitance-based switching of RF is highly attractive. Along those lines, MEMs has been used to form electrostatically adjustable capacitors for such switching. In essence, an electrostatic deflection of a microbeam changes the gap of a capacitor and therefore the capacitance value. Such switches can be used to construct DMTLs or "distributed MEMs transmission lines". These are known to be directly useable for constructing phase shifters, delay lines, variable and tunable filters, tunable resonators, and configurable antennas, for example. We realized herein that using our invention, we can provide an equivalent capacitor or capacitor-switch wherein the movable or deformable electrode or dielectric material is one of our droplets, bubbles or films, for example. Those familiar with making MEMS RF switches will be aware that doing this instead with a movable or deformable droplet can be much easier, cheaper, and more compact than doing it with MEMs components. Thus, by moving such a droplet, one could make a capacitance switch for RF and thereby also provide such useful circuit functions. It also allows for simpler MEMs rather than just the elimination of MEMs.

Therefore, a droplet fluid, flowable droplet or microbubble of the invention may have conductive or insulating properties and controlled dielectric constants, depending on which embodiment is implemented to manipulate which form of energy. By "flowable", we mean fluidic flow, distortion of shape due to growth or applied forces or fields, transport of a preformed droplet or even condensation (or evaporation) of a droplet. In other words, "flow" is any creation, destruction or transport of our droplet or bubble, regardless of the mechanism used to cause or enable it. During such formation and/or destruction, new material interfaces are flowing and changing size and/or shape. The flowable material may be any flowable material under at-least some circumstances. Thus, for example, a solid wax could be melted to flow. A pseudo-solid gel could be flowed simply with pressure, forced displacement or pumping. A liquid, paste, cream, solution or mixture could have a bubble thermally formed therein, have a bubble injected under pressure into it, or have a different material droplet or microbubble placed in it. All of these involve the motion of material interfaces to create the microbubble or microdroplet.

BRIEF DESCRIPTION OF THE FIGURES

FIGS. 4*a* and 4*b* each comprise a side elevational view and a plot of frequency and time, depicting the creation of new acoustic components contributing desired acoustic behavior to an acoustically propagating signal energy.

FIGS. 5*a* and 5*b* are side elevational views depicting the switching or modulation of RF energy using a disposed reflecting or attenuative droplet.

FIG. 6 is a side elevational view, depicting a variable capacitor utilizing a droplet.

DETAILED DESCRIPTION OF THE INVENTION

Figure 1A:
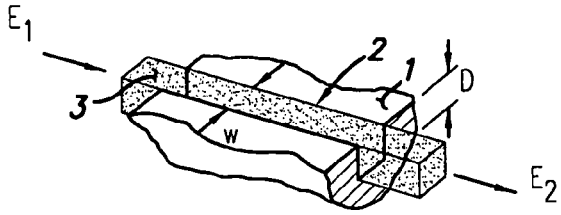
FIGS. 1*a* and 1*b* are perspective views, depicting a fluid or gas filled microchannel acting as an energy waveguide and the same waveguide when a microdroplet or microbubble is introduced therein to cause switching or modulation of the waveguide energy.
Figure 1B:
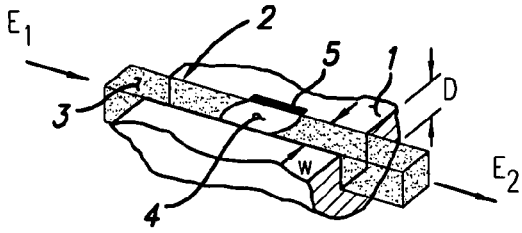

Moving now to FIGS. 1*a*-1*b*, we see in FIG. 1*a* a substrate 1 having a fluid channel 2 therethrough. The channel is of width W and depth D. An acoustically conductive liquid 3, such as water, is depicted filling the channel and may or may not be flowing. An acoustic energy $E_1$ is shown directed into the channel 2 on the left hand side and emanating from the channel 2 as energy $E_2$ on the right side, which, for the sake of argument, is the same as energy $E_1$. $E_1$, $E_2$ could, for example, be a 1 megaHertz sine-wave acoustic wave.

In FIG. 1*b*, we see the same substrate 1 and channel 2 of width W and depth D. However in FIG. 1*b*, we note that there is now a small thin film heater 5 which has formed a vapor bubble 4. Let us assume that the vapor 4 is that of fluid 3. It should be clear that acoustic energy $E_1$ still shown entering the left hand side of channel 2 will now emanate as a different energy $E_2$ from the right side of FIG. 1*b*. In fact, if the bubble 4 blocks the entire channel 2 in FIG. 1*b*, it is likely that energy $E_2$ of FIG. 1*b* will be zero. In this manner, we can electrically switch vapor bubble 4 on or off via heater 5 to switch (or otherwise modulate) acoustic energy $E_1$. We could also grow the bubble 4 to various sizes and only partially block channel 2. Thus, energy $E_2$ can be modulated and even shut off completely using our microbubble switch 4.

It should be clear that if vapor bubble 4 does not block the entire channel 2, then some of energy $E_1$ will pass around or leak around the bubble and some will be reflected backwards and sideways from the bubble, depending on the exact bubble shape, size, and acoustic wavelength(s) which are propagating according to known acoustic reflection and refraction laws. Acoustic practitioners will also be aware that a minuscule amount of $E_1$ may be detectable on the far side of the bubble 4 because of liquid to gas to liquid coupling known to be very weak but usefully effectively zero for most purposes.

Thus, one may utilize a bubble 4 or bubble-array to switch on and off acoustic energy, to modulate the intensity of acoustic energy, or to redirect acoustic energy as by reflection in a controlled direction down another channel, for example. We include in the scope the dynamic modulation of the bubble (or droplet) in terms of size, shape or position as well as bubble formation by any known microbubble formation method for purposes of achieving the switching, modulation or redirection of the invention. It is known that such microbubbles, for example, can be formed not only by thermally heated resistive films 5 but also by the impingement of a laser beam to cause a tiny hotspot or even by acoustic cavitation. Alternatively, one may have a preformed bubble that is pushed (or grown) into the channel 4 from a laterally disposed chamber or cavity (not shown). In this manner, for example, a bubble 4 could be grown inwards from two or more channel surfaces such that any remaining connecting meniscus of liquid is relatively symmetric in shape.

We emphasize in all of these embodiments of the invention herein that our switching bubbles droplets 4 may be implemented in channels, in channel arrays, on surfaces, between surfaces, in interfaces or even in permeable or porous materials in a bridging manner, etc. We look at all of them as components for building systems. We anticipate a common application to be the provision of an acoustic-source manifold along which there are arranged numerous bubble-decoupleable acoustic sub-devices which can selectively tap acoustic energy from the source manifold as it is locally needed.

Finishing with FIG. 1*b*, we explicitly note that "fluid" 3 could alternatively be a gas such as air and entity 4 could alternatively be a liquid droplet 4. In this scenario, acoustics propagating down the gas-filled microchannel 2 would meet a large acoustic impedance mismatch at the intervening droplet 4. Again, switching or modulation could be provided, depending on degree of blockage and the droplet(s) shape(s) and symmetry.

Figure 2:
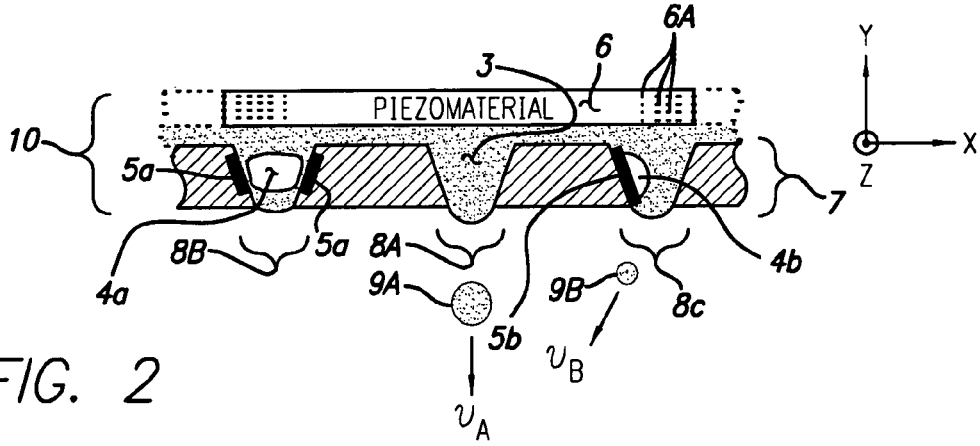
FIG. 2 is a cross-sectional view, depicting microbubble switching or modulation of an array of piezo-driven inkjet orifices.

Moving now to FIG. 2, we apply the bubble-switching and manipulation means to inkjet printing. In FIG. 2, we see an inkjet head 10 comprising a common multilaminate piezoemitter material 6 and an inkjet aperture or orifice plate 7. Note that the multiple co-laminated sublayers 6*a* of piezomaterial 6 comprise a known method of achieving high acoustic output with low driving voltages and good impedance-matching, as is practiced in piezo-jet personal printers. Note that an ink-fluid 3 is disposed in inkjet head 10 and that a droplet 9*a* of the ink has just been emitted at velocity VA from bubble-free aperture or orifice 8*a* as the entire slab of piezomaterial 6 has emitted a pulse downwards. Further, note that the other two apertures shown, 8*b* and 8*c* have vapor bubbles 4*a* and 4*b*, respectively, situated inside of them in different locations.

Because of the presence of vapor bubble 4*a* in aperture or orifice 8*b*, we have no droplet emitted from aperture 8*b*, since the acoustic energy from emitter 6 cannot substantially pass through or around vapor bubble 4*a*. Thus, vapor bubble 4*a*, as formed in this example using thermally-heating thin films 5*a*, has effectively acted as an acoustic switch and a microfluidic switch because it has both blocked acoustic propagation and has also blocked fluid flow due to that acoustic energy. Now, looking at aperture 8*c*, we similarly see a bubble 4*b* formed by thin film heater 5*b*; however this bubble 4*b* does not completely block aperture 8*c*. Therefore, we see a droplet 9*b* which is likely smaller than droplet 9*a* and is directed at an angle with a different velocity $v_B$. The angular emission of droplet 9*b* is due to the asymmetric fluid flow in orifice 8*c* caused by the asymmetric bubble location.

The point here is that we have used a monolithic piezoemitter 6 having only one hot lead and one ground lead and one switch (none of these shown) whose common single pulsed waveform has emitted droplets from multiple apertures which we switched on or off (or somewhere in between as for aperture 8*c*) using vapor bubbles. Given the concept, a number of inkjet applications become possible for our switching or modulating droplets and we will list some of them here. Not all microbubbles or microdroplets need be located at the exit orifices; some may be in the interior plumbing of the inkjet head or distribution manifold. Some inkjet-related applications include:

a) switching on or off or modulation of an emission event at or near an orifice (shown);
b) switching on or off or modulation of an emission event from a point remote from an orifice (wherein the remote bubble thereby affects the pressure pulse seen at the orifice(s) for example);
c) switching between inks (different colors for example) routed to one or more apertures, the switching being orifice-local or orifice-remote;
d) variable fractional mixing of ink colors routed to one or more apertures to achieve a mixed color, whether done at a local orifice or remote from such an orifice;
e) droplet size or shape modulation by blocking flow to a degree or by sapping energy form the ejection pulse, such as by orifice-local or orifice-remote bubbles;
f) droplet selection or rejection in a continuous inkjet or single-pulse inkjet, for example wherein the transitory or dynamic bubble diverts ink to or away from the path to the paper in a manner analogous to selection-electrodes on existing continuous inkjet printers;
g) bubble switching, on or off, of a piezo-emitted droplet from one or more apertures or orifices having one or more common or dedicated piezo-emitters. (FIG. 2, for example);
h) droplet redirection, such as by bubble-induced angled ejection or such as by using a bubble to switch acoustic energy between the two legs of a Y shaped channel;
i) droplet velocity changes, such as by using droplets to interfere with flow out the orifice or such as by placing droplet(s) anywhere in the ink or working fluid such that acoustic pressures are selectively reduced because the bubbles collapse and minimize peak pressure achieved;
j) control of the active area of an inkjet array of orifices, for example, using bubbles to turn an operating 30×3 array into an operating 10×3 array;
k) changing the shape or length of an aperture or orifice to affect the shape or length of one or more droplets, jets, streams or liquid films emitting from the aperture(s) (as an example, one could make a variable-length slotshaped orifice or one could use orifice bubbles to achieve a smaller droplet size via constriction and pulse shaping effects);

l) making or breaking an electrical connection in a conductive ink using an insulating bubble (such a connection, for example, could provide bias for droplet charging);

m) fine-tuning of the acoustic resonance and impedance of an inkjet for energy-efficient or high-frequency performance (for example, the use of disposed bubble(s) which purposely deform during an emission pulse, with the deformation controllably shaping the pressure waveform);

n) provision of a mixed technology piezo and thermal-bubble technology wherein the piezo (or thermal-bubble) provides the primary emission energy and the inventive thermal-bubble (or piezo) allows independent modulation of the emission event;

o) switching among apertures or orifices having different exit angles toward the paper workpiece;

p) switching or modulation of or among multiple available piezo-emitters, perhaps having different operational frequencies, via selective addition or subtraction of chosen ones;

q) control of satellite droplets; and r) control of microstream breakup by modulation of the stream by an oscillating bubble or droplet-such as is done, for example, by piezo-crystals to cause continuous inkjet droplets to all have the same size.

We emphasize that one may utilize one or more flowable liquids or inks 3 (In FIG. 1 or 2) which may or may not be miscible. Preferably, the ink has a vapor pressure at a low enough temperature that the ink is not burned or damaged by being in contact with a bubble 4. Recall again that our bubble, if a bubble is used, may comprise a vapor bubble of the channel liquid or may comprise an air bubble, for example, which is forced into the path. The invention does not require that bubbles and droplets be native to the medium in which the acoustic energy is propagating. However, in many cases, this is a great convenience.

A particular application of FIG. 2 would be to very large inkjet arrays. Such an array could have, for example, a low-voltage for bubble formation and a higher voltage for piezo operation. Since one can use a common piezo emitter, one can minimize the amount of high-voltage switching (and cost) which must be done. One or both of the emitter 6 or aperture layer 7 could be field-replaceable or be a consumable. We foresee piezo-material 6 driving several if not hundreds of orifices, with the switching being done by the low-voltage formed bubbles. Since we now have the option of running the piezomaterial 6 in constant oscillation, it can do so more energy efficiently compared to constant stopping and starting in drop-on-demand mode. In any event, in FIG. 2, our switching bubbles 4*a* can block pressure pulses or shock waves intended to drive fluid outward, regardless of how the pressure pulse or shock wave originated.

We also note that an historic problem of thermal-type inkjet printers has been burning of the ink and buildup of ink residue at the thermal bubble-making resistors. If such buildup happens on heaters 5*a* or 5*b* in FIG. 2 for example, we could utilize pulsing of piezo-emitter 6 to forcibly scour or clean the jet orifices. In this manner, we are making thermal bubble heaters last longer than they normally would with respect to the buildup failure mechanism. In fact, if one wished, one could design the apparatus of FIG. 2 to have a cleaning cycle wherein a separate cleaning fluid can be run through the orifices and energized for scrubbing action by piezo-emitter 6.

We have taught the use of microbubbles for switching or modulating droplet emission events such as in the inkjet printer head of FIG. 2. We emphasize that in this embodiment, the microbubble effectively switches the pulsatile flow of ink 3 caused by the piezo-crystal 6. This pulsatile flow is a direct result of the acoustic shock wave. Thus, in the scope of the invention, when we say "switching' of acoustics, we can mean switching of the energy itself (e.g., FIGS. 1*a*-1*b*) or switching of the ability of the energy to perform a task, such as inkjet droplet 9*a* emission (e.g., FIG. 2).

Figure 3A:
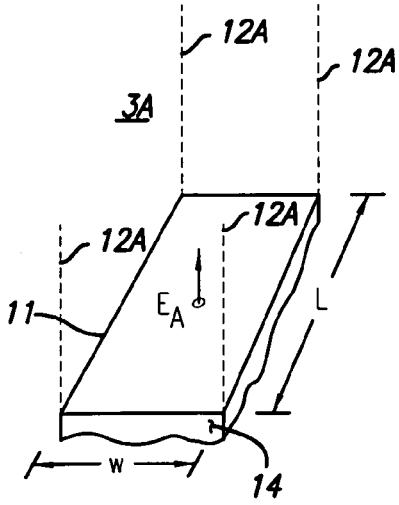
FIGS. 3*a* and 3*b* are perspective views, depicting switching the aperture size or shape of an acoustic beam.
Figure 3B:
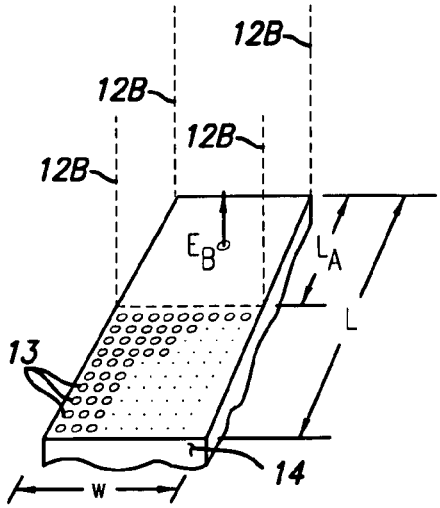

Moving now to FIGS. 3*a*-3*b*, we show an example wherein a bubble or bubble array is utilized to control the operational aperture or window that defines the shape of an emanating acoustic beam. Such apertures are sometimes controlled in diagnostic ultrasound transducers by complex high-voltage electrical-switching means. FIG. 3*a* shows an upwardly emitting transducer aperture 14 of length L and width W. The upwardly directed acoustic energy indicated by EA emanates from the entire area bounded by dimensions L and W. The edges or outline of the beam is defined further by phantom lines 12*a*. So, in general, this is a rectangular upwardly directed beam. Moving now to FIG. 3*b*, we see the same upwardly emitting transducer 14 but here we have "turned off" half of the emitter face with a disposed array of bubbles 13. Thus, we now have upwards propagating acoustic energy indicated by $E_B$ in the remaining unblocked portion of width W and smaller length $L_A$. The remaining acoustic energy $E_B$ emanating from the area bounded by width W and length $L_A$ is therein defined by phantom lines 12*b*. Close-packed (or merged) bubbles 13 cannot appreciably be crossed by the upwards propagating acoustic energy due to their large acoustic reflection coefficient.

It should now be obvious that one may dynamically and even selectively switch the bubble-forming means (resistive heaters on substrate 14 of FIG. 3*b* for example, not shown) such that moving patterns of ultrasound emission can be created. Such movable patterns (or beams) would be particularly valuable for the acoustic manipulation of matter using acoustic streaming-pressure. Thus, for a lab-on-a-chip device containing flowable specimens that need to be moved around, one could do such moving via switching of microbubbles in the path of an acoustic emitter, most simply a single common emitter 14.

We emphasize that our bubble switches or modulators could alternatively be remotely situated from the piezo or other acoustics-producing means. Thus, one could use our bubble arrays much as spatial-light-modulators are used, namely, downstream from their actual optical source whose emissions they act upon. Such a device could be called a SAM or spatial acoustic modulator.

Moving now to FIGS. 4*a*-4*b*, we show an arrangement wherein the bubbles are utilized to change the spectral content of an incoming acoustic wave or signal in a controlled fashion. In FIG. 4*a*, we see an acoustic energy or wave $E_1$ moving into and through a channel (or waveguide) filled with a liquid 16 in a substrate or block of material 15. The energy or wave is shown emanating from the right hand side as energy or wave $E_2$. Item 17 depicts a few of the individual wavefronts of energy or wave $E_1$. At any rate, for FIG. 4*a*, energy or waveform $E_1$ is selected to have a fundamental frequency of $f_0$ in the form of a sine wave of amplitude A as shown. Thus, exiting waveform or energy E2 of FIG. 4*a* is substantially the same as that of ingoing energy or waveform $E_1$.

Moving now to FIG. 4*b*, we have modified the arrangement of FIG. 4*a* by forming in the conduit, channel or waveguide of liquid 16 three vapor bubbles of three different sizes at thin film heaters 19, 20 and 21. Again, we see incoming sine-wave energy $E_1$ at $f_0$ frequency in the form of individual wavefronts 17. However, as one skilled in the acoustic arts will recognize, the three vapor bubbles shown can affect the outgoing energy or waveform $E_3$ of FIG. 4*b*. In particular, let us assume that the three vapor bubbles are stable and static in nature, meaning that the thin film heaters 19, 20, 21 utilize a steady DC electrical current to hold constant bubble sizes, for example. It is known that an external "pumping" acoustic wave as represented by incoming energy or waveform $E_1$ of FIG. 4*b* will cause the bubbles to themselves responsively resonate as indicated by waveforms 18 emanating from the middle bubble. Practitioners of acoustics will know that the extent and amplitude of bubble oscillation will primarily be a function of the ratio of the driving frequency ($f_0$ in this case) to the natural resonant frequencies of the three bubbles. In general, smaller bubbles have higher resonant frequencies.

Now, if we change incoming energy E1 of FIG. 4*b* to a broadband (broad frequency range) (not shown), we can therefore expect to excite each of our three small bubbles at its own responsive resonant frequency and less so at frequencies away from their resonant frequency in the known manner. We have shown three such driven responses at $f_{19}$ (for the smallest bubble 19), $f_{20}$ (for the middle size bubble 20) and $f_{21}$ (for the biggest bubble 21). In other words, a broadband driving frequency (not shown) will encourage energization of the three bubble resonances, particularly if those three resonant frequencies are within the range of the broadband driving energy. Thus, in the exiting acoustic energy $E_3$ which, before bubble formation was identical to broadband driving frequencies in $E_1$, will now have pronounced resonant peaks or troughs at frequencies $f_{19}$-$f_{21}$ in addition to most of the original broadband signal $E_1$ of this example. We can essentially influence the acoustic behavior of the system by disposing bubbles and driving them into one or more fundamental and harmonic modes. Furthermore, it should also be obvious now that one could electrically drive thin film heaters 19, 20 or 21 with an electrical sine wave that would cause the bubble to oscillate at that frequency in response. This can be done even without any driving energy $E_1$, as it is purely thermally driven. In any event, the electrical driving frequency shows up acoustically as driven bubble acoustics. Passive (nondriven) bubbles can make particularly good frequency filters for an incoming signal $E_1$. Actively electrically driven bubbles can make particularly good frequency sources for addition of frequency components to $E_1$.

So we have here in FIGS. 4*a*-4*b* a method of modulating a starting or pre-existing energy waveform or of creating new waveforms. These mechanisms could also be combined. In these manners, it becomes possible to create or modulate acoustic spectra via bubble (or droplet) disposition and manipulation. A particular embodiment of practical value is wherein one modulates an acoustic energy spectrum $E_1$ in a time-varying or selective way by electrically creating, growing, shrinking and destroying such bubbles. Those familiar with the phenomenon of thermoacoustics will also be aware, as mentioned above, that thin film heaters operated in contact with a fluid will create fluid-coupled acoustics because of thermal expansion effects. In fact, this is a very efficient means of creating acoustics in fluid channels, particularly if the heaters are air-backed, as is known. So within the scope of the invention is an arrangement wherein thermoacoustic (directly fluid coupled without a bubble) heaters create acoustics and those acoustics are then optionally modulated, modified, switched or redirected by our vapor bubbles as we have taught in the invention. This combination of elements, in principle, can allow the creation of a wide range of arbitrary acoustic waveforms for selected use.

Our next embodiment, that of FIGS. 5*a*-5*b*, is capable of switching or modulating RF electromagnetic energy. Looking at FIG. 5*a*, we see an electromagnetic energy $E_4$ entering a conduit or waveguide in a substrate of body 22. Individual EM waveforms 25 can be seen. In our example here, the "fluid" in the conduit is a gas, such as air. Air-filled RF waveguides are commonly known. RF energy $E_4$ of FIG. 5*a* is also shown exiting the conduit or waveguide as substantially unaltered energy $E_4$. We remind the reader that by RF we include frequencies from the megahertz range all the way up to the tens of terahertz range. Shorter wavelengths (higher frequencies) frequently utilize increasingly small waveguides. Such waveguides can be implemented as tubular forms or as channels or conduits (shown). It has recently been demonstrated that waveguides can also be formed from lattices of nanomaterials or MEMs-style microstructures.

Now moving to FIG. 5*b*, we note that we have disposed an electrically conductive liquid droplet 24 or a droplet having different dielectric constant than air in the path of the energy $E_4$ such that little or no energy $E_5$ emanates from the conduit or waveguide.

For example, liquid 24 is chosen to have a dielectric constant different than air. Just about any liquid has a dielectric constant different than air, thereby causing some reflection and some absorbtion/attenuation of energy $E_4$ in droplet 24. A hydrocarbon liquid or water, for example, would provide this effect and the effect would be larger the deeper the droplet is in terms of the number of wavelengths up to a known skin-depth. We include in the scope the removal or sinking of heat from droplet 24, as such heat may be generated by the desired electromagnetic attenuation.

Another liquid droplet 24 example would be an electrically conductive ferrofluidic droplet as moved into place by magnetic or electromagnetic forces. Such a conductive droplet will reflect most of the energy $E_4$ and attenuate the rest, thereby acting as an RF switch. Ferrofluids are suspensions of magnetic particles in a carrier liquid that are clumped and moved via magnetic (or electromagnetic) forces. A mercury droplet could, alternatively, serve the purpose of blocking energy $E_4$ also.

It will be recognized by those skilled in the art that one may, analogous to the acoustic embodiments, not only reflect and attenuate waves but redirect RF waves by controlled angled reflection and refraction. In essence, we are employing disposed and deformable droplets to form dynamically variable-shaped and tuned waveguides. This was not possible prior to these teachings.

It would be very attractive to be able to integrate millimeter and submillimeter RF waveguides into a substrate. For example, at 1 terahertz, the waveguide could be an electrically conductive channel (at least the channel walls are conductive) having width and dimension of about 0.3 mm, according to known design methods. We anticipate at least two generic approaches to utilizing this invention for such applications:

Disposition of reflective droplets to block, terminate or limit the dimension of a waveguide or of an active RF component such as a mixer or diode.

Filling of waveguides or volumes with the droplet liquid and subsequent formation of local bubbles which themselves now comprise waveguides or portions of active components-being gas-filled.

It will be apparent to the RF, microwave and higher-frequency engineer that such bubbles and droplets, formed and disposed in any manner (such as by in-situ thin film heaters) provide a fundamentally new tool to dynamically change and adapt RF circuits and to also provide adjustment and tuning to RF components which have until now been fixed in behavior and arrangement. One or more bubbles or droplets may be combined to create a combined shape that, for example, has one-quarter wavelength characteristic dimension, as known in the art. Further, the inventive microdroplets, microbubbles or microfilms could also be employed to form waveguides. As an example, an elongated vapor bubble in a conductive liquid could serve as an electromagnetic waveguide.

Finally, we turn to FIG. 6. Shown is a capacitor structure comprising opposed electrodes on two substrates 22*a* and 22*b*. A droplet 24*a* is shown having been admitted to the gap between the substrates that comprise electrodes A and B of the capacitor. A port 27 through which such a droplet 24*a* could be admitted is shown in phantom. It will be apparent that by varying the size of the droplet between zero and finite values, we can directly affect the capacitance value. Ideally, the droplet has a dielectric constant appreciably different than whatever material is present when the droplet is not present (air, for example). Given the foregoing concept, there are immediately several variations that become apparent and are not shown. One variation would have the droplet 24*a* be an electrically conductive liquid (say a ferrofluidic liquid or mercury, for example) and have it grow or shrink while deformed against an insulator layer on the opposite side of which is the other capacitor electrode. In this manner, the changing droplet size varies the lateral dimension of the capacitor b acting as a variable-size electrode. However, for the arrangement shown in FIG. 6, the insulating liquid droplet 24*a* varies the dielectric constant of the "filler" material between the electrodes. Such structures can provide capacitive switches for switching RF, for example.

The foregoing description has been directed to explaining the drawings. With that description now in hand, the following further details are provided.

The present invention is directed to an energy switching, modulation or redirection device comprising:

- a source of energy or potential which is to be switched, modulated, redirected or have further energy injected into; and
- a means of introducing at least one droplet, bubble or film into or energetically coupled to the path of the energy;
- wherein the droplet, bubble or film causes at least one of reflection, refraction, diffraction, attenuation, sapping, scattering, dissipation, redirection, polarization or filtering of at least one component of the energy due to the droplet, bubble or film being coupled into the path or wherein the droplet, bubble or film causes injection of additional or new energy into the path due to the presence or driven-nature of the droplet; and
- wherein the energy comprises at least one of acoustic, electrical, magnetic, electromagnetic, kinetic, RF, thermal or nonvisible optical energy or any other nonvisible optical energy or potential.

In the use of the device, the energy preferably, but not necessarily, passes or is passed through or along a substrate or waveguide before and/or after the switching, modulation or redirection.

Also, the droplet, bubble or film is preferably at least one of formed or manipulated by at least one of a) a heater, b) a MEMs-based manipulation means, and c) electrical, electrostatic, electromagnetic, mechanical, optical, magnetic, thermo-optical, thermo-acoustic, acoustic or pressurization forces.

A microfluidic channel or film may beneficially be employed, coupled-to or part of the device itself in the case wherein the energy propagation is within a liquid.

The energy being switched, modulated, redirected or otherwise modified (or injected) may, for example, be employed to cause emission, ejection or release of droplets of a flowable material for a useful purpose such as inkjet printing of marking-inks or of biomaterials into bioarrays. The invention is not limited as to how the so-manipulated energy is beneficially employed or directed.

The device may be employed in applications such as an inkjet printer or in a product which requires emission of droplets of material in a desired temporal or spatial pattern wherein the microbubble switching action provides the temporal or spatial patterning ability. The device may also be employed in a lab-on-a-chip product wherein localized switching or manipulation of an energy or potential allows for controlled processing, analysis or storage of clinical specimens, for example.

If the energy employed in the device is RF or radiofrequency energy, it will preferably have at least one frequency component in the range of 0.1 megaHertz to 10 or more teraHertz, as is known to the electromagnetic arts.

In the device, one of more droplets, bubbles or films may be formed in an interface, the droplets, bubbles or films providing or breaking bridged contact or contacts between the interfaces such that the energy or potential can or cannot propagate across the interface.

Alternatively or additionally, the formation or destruction of one or more microbubbles, microdroplets or microfilms may be employed to form energy waveguides themselves whose function is merely (at least) to transport the energy with acceptable losses. Thus, the invention allows for the formation of waveguides and switching/modulation/redirection/injection components which can be placed along the waveguides.

Further, at least one bubble, droplet or film may have a characteristic dimension (at least a point in time) that is derived from a knowledge of a wavelength of the energy. In this manner, known resonant and anti-resonant behaviors known to those familiar with tuned circuit design can be taken advantage of.

Typically, at least one droplet, bubble or film at least one of: a) serves to switch, modulate or redirect an energy, energy component or potential energy, b) serves to inject a signal into an energy-path which may or may not already have preexisting energy in it, c) forms at least a portion of a waveguide or routing means for an energy, energy component or potential, d) has a generally spherical, hemispherical, polyhedral, ellipsoidal, body-of-revolution or elongated shape, e) forms a portion of a circuit, f) provides for a reconfigurable antenna or a former of selectively-aimed beams of the energy, or g) is an element of a phase-shifter, tunable resonator, tunable filter, delay line or capacitive switch.

In the case of the droplet, bubble or film performing the signal-injection function, then one would typically drive the bubble (or droplet volume) such that it bleeds or injects energy into the coupled energy path. A typical way of doing this would be to thermally oscillate a thermally-formed microbubble or droplet-volume of liquid or flowable material. We note that in the extreme example of this signal-injection embodiment, we can have a bubble or film of zero-dimension wherein, for example, a thermoacoustic excitation of a liquid is provided which does not involve a phase-change from liquid to vapor. We explicitly note that any energy used to form or drive our inventive microbubbles or microdroplets may be of a different type and from a different source than that being switched or modulated by the microbubble or microdroplet. So, for example, a microbubble formed by an electrical resistor could be used to switch acoustical energy.

Droplets, bubbles or films may be arranged in a pattern or wherein the bubble or droplet introducing means are arranged in a pattern. The effects of arrayed or patterned objects on radiating energy are well-known, particularly with regards to reflection and diffraction effects. This is particularly true wherein the radiating energy has a wavelength which is on-the-order-of a pitch or spacing dimension of the array or pattern or wherein the microbubbles or microdroplets themselves have a dimension which is on-the-order-of the energy wavelength. In these cases, trigonometrically-predictable wave redirection takes place.

Also in accordance with the invention, a device is provided for introducing an acoustic signal into an acoustically conductive medium. The device comprises:

at least one droplet, bubble or film acoustically coupled to the acoustic medium; and at least one associated droplet, bubble or film formation, growth, shrinkage or movement means;

wherein the droplet, bubble or film formation, growth, shrinkage or movement means alters a dimension, pressure, shape or location of the droplet, bubble or film in a manner sufficient to produce the desired acoustics; and wherein the acoustics is introduced into the medium by acoustic coupling of the bubble, droplet or film to the medium.

In this acoustic introduction device, the droplet, bubble or film may preferably be dynamically altered or moved using thermal means to produce thermoacoustics.

Further in accordance with the present invention, a device for filtering a source of energy is provided. The device comprises:

a source of energy which is to be filtered; and a means of introducing at least one droplet, bubble or film into or energetically coupled to the path of the energy;

wherein the droplet, bubble or film is driven by sapping energy from the passing energy stream to deform, distort, polarize, charge, attenuate, undergo phase change, oscillate, reflect, diffract or otherwise selectively absorb selected portions of the passing energy; and wherein the selective removed, sapped or absorbed portions of energy are portions that are thereby desirably filtered from the energy source.

In the filtering device, the energy to be filtered may comprise at least one of acoustic, electrical, electromagnetic, magnetic, kinetic, RF energy, or nonvisible optical energy.

In accordance with yet another aspect of the invention, a device for regulating the controlled breakup of a stream or jet of flowable material is provided. The regulating device comprises:

a stream or jet of flowable material or fluid;

a droplet, bubble or film disposable in or physically couplable to the stream or jet; and an associated droplet, bubble or film formation or introduction or coupling means;

wherein the droplet, bubble or film is dynamically deformed, pressurized, created/destroyed or grown/shrunk such that it introduces controlled pressure or shape perturbations to the stream or jet; and wherein the stream or jet thereby is thereby favorably separated into controlled emitted (or passed) portions of controlled size or volume.

In the regulating device, the bubble, droplet or film may regulate a stream or jet of ink in a printing or patterning device and the stream or jet is broken or encouraged to break into ink drop portions of desired size, spacing or frequency.

In accordance with yet another aspect of the present invention, a device for the controlled selection or deselection of portions of an emitted or emitting stream or jet of flowable material is provided. The selection/deselection device comprises:

a stream or jet of a working flowable material or fluid;

means for deciding or controlling which portions of the stream or jet are to be at least one of physically selected or deselected;

means for altering the path of the selected or deselected portions via interaction with a disposed or disposable bubble, droplet or film of a second flowable material;

means for selectively forming or placing the disposed bubbles, droplets or films;

wherein the altered path is different than the unaltered path; and wherein the result is selected portions on one path and deselected portions on another path.

In the preferred selection/deselection device, the stream or jet is of a material to be printed or patterned upon a surface, such as an ink or a fluid utilized in a lab-on-a-chip or bioanalytical instrument. In the preferred device, the bubble or droplet doing the selection may be made up of a different material or of the same material as is being emitted. A preferred variation is wherein the bubble material is the vapor form of an emitted liquid.

In accordance with still another aspect of the present invention, an acoustic pulse modulation device is provided for modulating an emissive pressure-pulse of a droplet, stream or jet emission apparatus. The acoustic pulse modulation device comprises:

an apparatus capable of emitting droplets, streams or jets of a flowable material or liquid for a useful purpose such as patterning of ink or biomaterials;

the apparatus including at least one orifice that emits droplets, streams or jets of the flowable material in response to at least one pressure pulse or waveform generated by or in the apparatus;

at least one disposed bubble, droplet or film in fluid or acoustic communication at any point with the flowable material before or during the emission event; and a bubble, droplet or film forming or introduction means;

wherein the disposed bubble, droplet or film is deformed during the emission pulse due to the emission pulse event and thereby saps and/or adds energy from/to the emission pulse; and wherein the sapping/adding of emission energy thereby beneficially modulates the emission energy such that a better emission waveform is attained. We explicitly note that the emission energy is typically being provided as by a piezoelectric transducer, for example, and our inventive modulating microbubble, regardless of how it is formed, is sapping or adding to that energy in order to favorably modify the waveform of that emission energy.

In the modulating device, the disposed bubble, droplet or film may modulate the size, frequency or velocity of one or more emitted droplets of flowable material. For example, the device may favorably tune the acoustic impedance or resonance of at least a part of the emission apparatus or emission chamber.

In accordance with another aspect of the invention, a device is provided for switching, modulating or redirecting the flow of emitted material from an orifice. The device comprises:

an orifice capable of emitting streams, jets or portions of flowable material in response to a pressure pulse or pressure gradient; and a bubble, droplet or film formation or introduction means;

wherein the bubble, droplet or film is placed in a manner by the formation or introduction means wherein at least one of: a) a pressure driving the emission is at least temporarily changed, b) a flow caused by the pressure driving the emission is at least temporarily blocked, redirected or throttled.

Also in accordance with an aspect of the invention, a device is provided for connecting or disconnecting a flow or application of a potential or flowing energy (voltage, current, temperature, charge, etc.) to a body capable of passing or further communicating that flow or potential. An electrical version of the device, for example, could comprise:

a body of electrically conductive fluid upon-which or to-which is applied a flowing electrical current or a static voltage potential, the voltage or current capable of serving a useful purpose downstream;

a bubble, droplet or film formation or introduction means;

the bubble, droplet or film material having different lower electrical conductivity than the conductive fluid or otherwise presenting at least a partial electronic barrier to current-flow or potential-application;

the formation or introduction means capable of placing a bubble, droplet or film at least partially in the path of the conductive fluid; and the placing acting to break or reduce the ability of current to pass or voltage to be communicated through at least a portion of the conductive fluid.

Still further in accordance with the invention, a method of locally modifying the energy-propagation properties or electrical propagation properties of a first medium with a second interposed medium is provided. The method comprises:

providing a first medium having known energy or electrical propagation attributes;

providing a second flowable or fluid medium having different known propagation attributes;

providing a means to dispose at least one droplet, bubble or film of the second medium within or juxtaposed to the first medium;

the droplet, bubble or film of the second medium at least one of blocking, throttling, redirecting, reflecting, diffracting, absorbing or attenuating or presenting an energy-barrier to propagation of an energy, current or potential in the first medium; and the modified energy being one or more of acoustic, RF, magnetic, electromagnetic, non-visible optical or electrical in nature.

In the method, the energy-modifying may contribute to the handling, modulation or processing of a useful signal embodied in the energy.

In accordance with the invention, a capacitor element capable of variable capacitance is provided. The capacitor element comprises:

first and second electrodes or their equivalents;

an intervening space for location of at least some disposed dielectric material;

the dielectric material comprising, at least in part, a variable dimension droplet, bubble or film, the droplet, bubble or film material having a different dielectric constant than an ambient; and means for varying a dimension of the droplet, bubble or film thereby directly affecting the capacitance value of the capacitor as the proportion of, volume of, or area of the dielectric material changes between ambient material and droplet, bubble or film material.

In the capacitor, a capacitive switch may be provided for the purpose of switching or modulating an RF, electromagnetic or magnetic signal.

Further, at least one of an RF or electromagnetic phase shifter, digital phase shifter, DTML (distributed MEMs transmission line), tunable filter, delay line, tunable resonator or reconfigurable antenna may be provided.

Also in accordance with the invention, an inkjet printer is provided, wherein the flow or motion of ink is at least one of switched, modulated or redirected by at least one disposed bubble, droplet or film of flowable material. In the inkjet printer:

the bubble, droplet or film is preferably not itself emitted to the paper or workpiece while doing so; and the bubble, droplet or film is selectively disposable, formable or shape-changeable in a position at or remote from an ink emission orifice or aperture.

Also in accordance with the invention, an inkjet printhead comprises:

a multiaperture or multiorifice emission portion;

an ink distribution means coupled to the emission portion and its apertures;

a common pulsed, pulsable or pressurized emitter operable in at least one of continuous stream, continuous droplet or drop-on-demand mode to push or squeeze ink out of at least two of the apertures or orifices each at some point during operation; and bubble, droplet or film means for introducing or forming droplets, bubbles or films within or coupled to the ink;

wherein the bubble, droplet or film means are utilized to selectively block or modulate the local acoustic energy driving ink from a particular orifice or the flow of ink which is able to exit at least one such aperture or orifice upon emitter pulsing; and wherein the droplet, bubble or film means thereby determine which apertures or orifices are active in terms of ink emission.

Also in accordance with the invention, an inkjet printer is provided which can operate in either or both of a continuous mode or drop-on-demand mode wherein the printer comprises:

in a continuous-mode streams, jets or droplets are emitted by the CW or continuous operation of a pulser, acoustic-shock, pressure-pulse or static pressurization means;

in drop-on-demand mode one continuously pulses or statically pressurizes the emitter means but selectively blocks or allows bubble, stream or jet ejection from selected orifices utilizing the inventive disposed bubbles, droplets or films of a flowable material positioned to enable or interfere with an ejection process; and the emitter means is common to at least two orifices. By continuous is meant at least a few cycles of oscillation for pulses and static pressure for non-pulsed pressurization.

Further in accordance with the invention, an inkjet printer is provided which utilizes a shockwave or pressure pulse to encourage or cause ink emission. The inkjet printer comprises:

a shockwave or pressure-pulse introducing means;

a body or reservoir of ink and an ink distribution means;

an aperture or orifice component out of which or from which ink portions are emitted from one or more orifices;

the shockwave or pressure-pulse introducing means operable to directly or indirectly force ink from at least one orifice;

bubble, droplet or film means capable of selectively forming or placing bubbles, droplets or films of a flowable material or fluid into or coupled to the path or body of the ink; and the bubble, droplet or film means favorably providing at least one of:

selective switching or modulation of ink emission from at least one orifice, selective switching among multiple ink types or multiple ink sources, controlled mixing of different inks or ink colors, selective switching of electrical potential or current to a stream or jet of ink or ink portions, portion velocity control or portion size control, portion emission angle control, satellite droplet or satellite-portion control, inkjet acoustic impedance or resonance control, turning off or deactivating of defective or dirty orifices, regardless of whether the flowable bubble, droplet or film is ever emitted from the orifice in any form and regardless of whether the flowable bubble, droplet or film is composed of an ink or ink constituent.

Also in accordance with the present invention, a device is provided for modifying energy, an energy beam or an energy potential field comprising:

a member having an arrangement of two or more bubbles, droplets or films of a flowable material or liquid, at least some of which can be selectively changed with respect to a physical property, dimension or position;

pre-existing energy to be modified, at least a portion of which is incident upon or in energetic communication with the arrangement;

the arrangement capable of modifying the incoming or communicated energy portion in a manner at least partly dependant upon the geometrical arrangement of the bubbles or droplets and/or dependant on a bubble/droplet/film dimension; and the modified energy having a useful characteristic different than the incoming unmodified energy.

In the energy-modifying device, the beneficial energy modification may involve any one or more of refraction, diffraction, redirection, focusing effects, diffusing effects, reflection, amplitude changes, polarization or phase-change effects, while the selective microbubble/microdroplet/microfilm changing may involve one or more of:

causing a variation in size, presence or spacing of one or more droplets, bubbles or films;

causing a variation in a physical, electronic, electromagnetic or optical property of one or more droplets, bubbles or films;

causing a variation in shape or composition of one or more droplets, bubbles or films for any period;

having hardware or software communicate a desired change-pattern to the arrangement;

having hardware or software implement a change-pattern based on a state of the pre-treated energy or the post-treated energy portion;

varying, at least on a statistical basis, a property of the arrangement;

applying a dynamic change-pattern to the arrangement, the pattern having a relationship to a predetermined or computed waveform; or changing the size or presence of at least one bubble, droplet or film via the use of thermal forces or forces induced by the application of a field or potential.

Further in accordance with the present invention, a device is provided for modifying the ability to couple energy, the flow of energy or the passage of an energy potential between a first entity and a second entity. The device comprises:

a first entity from which energy or potential is to be passed, transmitted, emitted or communicated from;

a second entity to which at least some of the energy or potential is to be passed, transmitted, emitted or communicated to or into;

at least one intervening space between at least a portion of the first and second entities;

the at least one space filled with a first material;

a second flowable material disposable as at least one of one or more droplets, bubbles or films into at least some of the at least one space;

the replacement of the first material with the second material, at least in a portion of the at least one space, changing a propagation parameter for the energy to travel through the at least one space; and means for controllably effecting the replacement.

In the modifying device, the propagation parameter is at least one of a reflection coefficient, a degree of refraction, an impedance, a conductivity, a transmissivity, a dielectric property, an RF parameter, an optical property or the height of an energy barrier.

The space can be incrementally occupied by one or more disposed droplets or bubbles of the second material or by an incrementally disposed or sized wettable film. The space may be a single space or a distributed space such as a porous or permeable region within a parent material.

The replacement of the first material with the second material may switch, modulate or redirect energy propagation or energy potential application from one or both of a) from the first entity to or upon the second entity, b) from the second entity to or upon the first entity, or c) from both entities to each other.

Software or hardware may be employed to give instructions relating to a state, parameter of, or pattern of at least one droplet, bubble or film area which are present or which are to be implemented.

The droplet, bubble or film second-material disposed in the space includes at least one of: a bubble of vapor of the first material; a bubble of a gas, air or plasma; a vacuum; a droplet or film of a formable or flowable liquid, cream, paste, gel, wax, oil, hydrocarbon-containing material, suspension, emulsion, or multiphase mixture; a material native to the first or second entity, regardless of phase; a solid, rigid or semirigid material, porous or not; a bubble, droplet or film which wets a surface; or a wetting material or a phase-changeable material such as a meltable material.

The first material in the space may include at least one of: a gas or air; a plasma; a vacuum; a droplet or film of a formable or flowable liquid, cream, paste, gel, wax, oil, hydrocarbon-containing material, suspension, emulsion, or multiphase mixture; a material native to the first or second entity, regardless of phase; a solid, rigid or semirigid material, porous or not; or a wetting material.

The disposition of the second material, at least in part, may be permanent or temporary.

The energy may include at least one of: acoustic energy, RF energy with a frequency measured in units of mehaHertz, gigaHertz or teraHertz, electromagnetic energy, optical energy, microwave energy, electrical energy as for flowable current or voltage which can be applied, thermal energy, infrared energy, kinetic or kinematic energy associated with mass-transport of a medium, any polarized or unpolarized energy, or any directional or nondirectional energy. As stated, the energy may also be in the form of an applied energy-potential rather than an energy flow.

The modified ability may include at least one of: changing the direction of passing energy; changing the ability of energy to pass; modulating passing energy in any manner; polarizing or depolarizing passing energy; filtering passing energy; adding to or impressing upon the passing energy a waveform or a new energy; changing the amount of area across which energy can pass; changing the pattern of how the area across which energy can pass is distributed; reflecting, diffracting, scattering, absorbing or attenuating some of the energy as it passes from one entity to another; controlling the reflectivity, impedance or resistance of energy flow between entities; modifying the ability in response to hardware or software sensing or computation; or converting the energy from a first form to a second form such as from RF energy to heat. Again, by energy we mean both the flow of an energy as well as the application of an energy potential.

Phenomena such as photonically induced or electrostatically induced wetting or dewetting or photonically-induced or electrostatically, electromagnetically or magnetically induced surface-tension driven shape-changes may also be utilized to manipulate or form the inventive bubbles, droplets or films. The energy, potential or work applied to manipulate or form our inventive bubbles, droplets or films will typically be of a different type than that which is being switched, redirected or modulated; however, they may alternatively be of the same type and even from the same or a similar source.

We have taught the production of acoustic waveforms and signals using our inventive droplets, bubbles and films, particularly if they are themselves driven as taught. Those familiar with acoustics will realize that the full acoustic spectrum runs from static pressure (zero hertz) all the way up to gigahertz and even terahertz. Thus, the invention can be employed to apply pseudo-static or static pressure to microfluidic lumens, for example, for technically useful time periods extending through the microsecond, millisecond, seconds and tens of seconds ranges and longer.

We have taught a means of selectively filtering a source of energy utilizing our inventive bubbles, droplets and films. Included in the scope of the filtering action is filtering that is accomplished actively or passively. By "actively", we mean that a parameter of the bubble is varied to cause the filtering. By "passively", we mean that even a stable bubble, droplet or film that has been so coupled can passively filter energy such as by simple acoustic or optical attenuation. We also include in the scope of the invention the selective passing or selective redirection of energy portions. In this manner, for example, a bank of frequency-dedicated or wavelength-dedicated filters can be implemented.

What we claim is:

1. An energy or energy-potential switching, modulation or redirection device comprising a source of energy or energy potential which is to be switched, modulated or redirected; and a means of introducing at least one droplet, bubble or film into or energetically coupled or couplable to at least one possible or existing path of the energy;

wherein the droplet, bubble or film causes or is available to cause at least one of reflection, refraction, diffraction, attenuation, sapping, leakage, blocking, scattering, dissipation, switching, modulation, redirection or conversion of at least one component of the energy due to the droplet, bubble or film causing a propagation discontinuity or disruption of said energy propagation; and wherein the energy or energy potential comprises at least one of acoustical, electrical, electromagnetic, magnetic, kinetic, RF, thermal, non-visible optical, chemical or photonic energy, X-ray or gamma energy, pneumatic or hydraulic energy, or any type of potential-energy or energy field.

2. The switching, modulation or redirection device of claim 1 wherein at least some of the energy or potential passes-along, is passed through or is trans-ported by a substrate or waveguide before, upstream-of, after, or downstream of at least one a switching, modulation or redirection event.

3. The switching, modulation or redirection device of claim 1 wherein the droplet, bubble or film is at least one of formed, manipulated or positioned by at least one of: a) a heater or heatable surface, b) a MEMs-based manipulation means, c) electrical, electrostatic, electromagnetic, mechanical or optical forces, d) magnetic, electromagnetic, photonic, acoustic, thermoacoustic or electrowetting forces or by a phase-change in a material, e) a surface-tension modification resulting in a wettability or shape-change as driven in any manner, f) pressurization forces or g) forced displacement.

4. The switching, modulation or redirection device of claim 1 wherein a microfluidic channel or waveguide is employed or is coupled thereto, the channel or waveguide being in or on a substrate or being self-supporting.

5. The switching, modulation or redirection device of claim 1 wherein the energy or energy-potential being switched, modulated or redirected is employed at any point to cause, enable or trigger emission, ejection or release of droplets or particulates of a flow-able or nonflowable emittable material for a useful purpose.

6. The switching, modulation or redirection device of claim 1 wherein an application is to an inkjet printer, an inkjet-type biomaterial patterning product or to any product or device which requires emission of droplets or particulates of one or more materials in a desired useful temporal or spatial pattern.

7. The switching, modulation or redirection device of claim 1 wherein the energy being switched is RF, radiofrequency, any electromagnetic energy or acoustical energy having at least one frequency component in the range of 0.1 megahertz to 10 or more terahertz or has at least one wavelength in the angstroms to centimeters range.

8. The switching, modulation or redirection device of claim 1 wherein one of more droplets, bubbles or films is formed in an interface, said droplets, bubbles or films providing or breaking bridged contact or contacts between the interfaces or modulating the transfer of the energy or energy-potential across the interface.

9. The switching, modulation or redirection device of claim 1 wherein at least one bubble, droplet or film has at least one characteristic dimension at least one point in time which is derived or chosen from a knowledge of a wavelength or frequency of the energy and affords beneficial interaction with the energy.

10. The switching, modulation or redirection device of claim 1 wherein at least one droplet, bubble or film at least one of: a) forms at least a portion of a waveguide, the redirection at-least in part comprising the waveguide guiding action b) has, at least in part, a generally spherical, hemispherical, ellipsoidal or body-of-revolution shaped surface or interface, c) forms a portion of a circuit which beneficially interacts with the energy, d) provides for a reconfigurable antenna, e) is an element of a phase-shifter, tunable resonator, tunable filter, delay line or capacitive switch, or e) is a film or body of wetting, wettable or dewettable material, f) is one of several comprising a pattern, or g) is formed or manipulated in conjunction with a phase-change or surface-tension change.

11. The switching, modulation or redirection device of claim 1 wherein at least one bubble, droplet or film has a) its size or a position or shape of one or more of its surfaces or interfaces forcibly varied with time resulting in said energy being modulated differently as a function of time or b) has a property forcibly varied with time, the changing property beneficially causing a change in the passage or application of the energy or energy-potential.

12. The switching, modulation or redirection device of claim 1 wherein droplets, bubbles or films are arranged in a pattern or wherein the bubble or droplet introducing means are arranged in a pattern, the pattern being two- or three-dimensional at least one point in time or the pattern being one-, two- or three-dimensional seen cumulatively over a period of time.

13. The switching, modulation or redirection device of claim 1 wherein at least one droplet, bubble or film is employed to at least one of: a) switch, modulate or redirect said source energy, or b) switch, modulate or redirect an action of such source energy at least one location or point in time.

14. The switching, modulation or redirection device of claim 1 wherein the energy path is obstructed, at least in part, by a bubble, droplet or film.

15. The switching, modulation or redirection device of claim 1 wherein coupled-to or coupling-to the path comprises placement of at least one droplet, bubble or film in a position which will result in said droplet, bubble or film at least one of: a) being deformed by the energy, thereby affecting the energy propagation directly or indirectly b) being heated by the energy as by attenuation of energy in the droplet, bubble or film, c) being altered by the energy as by a phase-change, polarization or electrical charging, or d) causing passage of the energy to interact with the droplet, bubble or film in a beneficial manner as by passage of the energy through, across or incident upon the bubble, droplet or film.

16. The switching, modulation or redirection device of claim 1 wherein the droplet, bubble or film comprises a solid, liquid, vapor or gaseous material having an acoustic or electromagnetic impedance, dielectric constant, loss-factor, polarization, energy barrier-height, transmissivity coefficient, reflectivity coefficient or diffraction parameter which presents a propagation discontinuity, disruption or directional change to the propagating energy or passing energy potential relative to a medium from which it was received or relative to a medium to or into which it could further propagate.

17. The switching, modulation or redirection device of claim 1 wherein the energy or energy-potential source also drives or at least supports emission of ink droplets, emitted droplets or other useful emittable particulates and said droplet, bubble or film beneficially interfering with or modulating said ink, droplet or particulate emission with respect to an amount, velocity or direction of emission.

18. The switching, modulation or redirection device of claim 1 wherein at least one bubble, droplet or film is employed to at least one of: a) aid in the mixing or gating of ink or of a working-fluid's flow within any portion of a printer or patterning apparatus, b) aid in the control of a direction, velocity or size of an emitted ink or working-fluid droplet within any portion of a printer or patterning apparatus, or c) aid in the definition or control of a size or shape of an active aperture of emission orifices in a printer or patterning apparatus.

19. A device for introducing an acoustic signal, pressure-waveform or static pressure into an acoustically transmissive or pressure-transmissive medium comprising:

at least one droplet, bubble or film acoustically or otherwise pressure-coupled to the medium; and at least one associated droplet, bubble or film formation, growth, shrinkage, driving or oscillation means;

wherein said droplet, bubble or film formation, growth, shrinkage, driving or oscillation means dynamically alters a dimension, shape, pressure or surface-tension of said droplet, bubble or film in a manner sufficient to produce the desired acoustics or pressure; and wherein said acoustics or pressure is introduced into the medium by acoustic or pressure-transmissive coupling of said bubble, droplet or film to said medium.

20. The device of claim 19 wherein the droplet, bubble or film is dynamically altered using thermal or photonic means to produce thermoacoustics or photoacoustics.

21. A device for filtering or otherwise sorting a source of energy comprising:

a source of energy which is to be filtered or sorted; and a criteria or parameter determining what filtering or sorting is to take place a means of introducing at least one droplet, bubble or film into or energetically coupled to a path of the energy;

wherein the droplet, bubble or film is driven by or penetrated by an incident or passing energy to deform, distort, polarize, charge, attenuate, undergo phase-change, reflect, refract, diffract or otherwise absorb, repel, redirect or pass selected portions of the energy according to the criteria or parameter; and wherein said selectively filtering portions or said selectively passed or redirected portions of energy are portions that are thereby desirably selected from the energy source for a useful purpose.

22. The filtering or sorting device of claim 21 wherein the energy comprises at least one of acoustical, electrical, electromagnetic, magnetic, kinetic, thermal, RF energy, visible or nonvisible optical energy, photonic energy, X-Ray energy or gamma energy.

23. A device for regulating controlled breakup of a stream or jet of flowable material comprising:

a stream or jet of flowable material or fluid serving a useful function;

a droplet, bubble or film disposed in or physically coupled to the stream or jet; and an associated droplet, bubble or film formation or introduction means for forming introducing the droplet, bubble or film;

wherein the droplet, bubble or film is dynamically deformed, oscillated, pressurized or presented such that it introduces, presents or communicates controlled pressure or shape perturbations to the adjacent stream or jet; and wherein the adjacent stream or jet is thereby favorably separated into controlled portions of controlled size, volume or shape at or downstream of that location.

24. The device of claim 23 wherein the bubble, droplet or film regulates or influences a stream or jet of ink or any other patterning-medium in a printing or patterning device and said stream or jet is broken or encouraged to break into ink or media droplet or particulate portions of at least one of desired size, spacing, frequency or shape.

25. A device for controlled selection or deselection of portions of an emitted or emitting stream or jet of flowable or emittable material comprising:

a stream or jet of a working flowable or emittable material or fluid;

means for deciding or controlling which portions of the stream or jet are to be at least one of physically selected or deselected;

means for altering a path of the selected or deselected portions via interaction with a disposed bubble, droplet or film of a second flowable or emittable material; and means for selectively forming or placing disposed bubbles, droplets or films and causing or allowing them to influence the stream or jet;

wherein said altered path is different than an unaltered path; and wherein a result is selected portions on one path and deselected portions on another path.

26. The device of claim 25 wherein the stream or jet is of a material or carries a material to be printed or patterned upon a surface.

27. The device of claim 25 wherein the emitted stream or jet is an ink or otherwise contains a marking material or medium.

28. The device of claim 25 wherein the emitted stream or jet is a fluid, biofluid or reagent or contains any working material utilized in a lab-on-a-chip or bioanalytical instrument, the fluid or material being deposited by the stream or jet in a desired spatial or temporal pattern.

29. An acoustic pulse modulation device for modulating an emission pressure pulse of a droplet, stream or jet emission apparatus comprising:

an apparatus capable of emitting at least one of droplets, streams or jets of a flowable material or liquid for a useful purpose;

the apparatus including at least one orifice that emits at least one of droplets, streams or jets of the flowable material in response to a pressure pulse generated by or in the apparatus;

at least one disposed bubble, droplet or film in fluid, acoustic or pressure-transmissive communication at any point with the flowable material before or during said emission; and a bubble, droplet or film-forming or introduction means for forming or introducing the bubble, droplet or film;

wherein said disposed bubble, droplet or film deforms during said pulse due to said pulse and thereby saps energy from the pulse; and wherein said sapping of energy thereby modulates the energy and resultant pressure still available to drive the droplet, stream or jet emission or otherwise favorably modifies an impedance of the emission means.

30. The device of claim 29 wherein said disposed bubble, droplet or film modulates the size, frequency or velocity of one or more emitted droplets of flowable material.

31. The device of claim 29 wherein said disposed bubble, droplet or films favorably tunes the acoustic impedance or resonance of at least a part of the apparatus.

32. A device for switching, modulating or redirecting a flow of an emitted material or material constituent from an orifice comprising:

an orifice capable of emitting streams, jets or portions of flowable material in response to a pressure pulse, pressure-gradient or static pressure, the material being a useful material or containing and transporting a useful material therein; and a bubble, droplet or film-formation or introduction means for forming or introducing a bubble, droplet or film;

wherein the bubble, droplet or film is placed in a manner by the formation or introduction means wherein at least one of: a) a pressure driving the emission is at least temporarily changed, b) a flow caused by the pressure driving the emission is at least temporarily blocked, redirected or throttled.

33. A device for electrically connecting, disconnecting or regulating current flow or application of potential to a body of electrically conductive fluid comprising:

a body of electrically conductive fluid upon which or to which is applied a flowing electrical current or a voltage potential, the voltage or current serving a useful purpose; and a bubble, droplet or film formation or introduction means for forming a bubble, droplet or film;

wherein the material comprising the bubble, droplet or film has different electrical conductivity or electronic barrier-height than the conductive fluid; and wherein the formation or introduction means is capable of placing the bubble, droplet or film at least partially in the or along the path of the conductive fluid, said placing acting to modify the ability of current to pass or voltage to be communicated through at least a portion of the conductive fluid.

34. A method of locally modifying energy-propagation properties or electrical propagation properties of a first medium with a second interposed or juxtaposed medium comprising:

providing the first medium, the first medium having known energy or electrical propagation attributes;

providing the second medium, the second medium being flowable or a fluid and having different known propagation attributes; and providing a means to dispose at least one droplet, bubble or film of the second medium within or juxtaposed to the first medium;

wherein the disposed droplet, bubble or film of the second medium contributes at least one of blocking, throttling, redirecting, reflecting, diffracting, refracting, polarizing, shunting, absorbing, attenuating or, alternatively, enhancing in any manner the propagation relative to a prior state wherein the energy is one or more of acoustical, hydraulic, pneumatic, RF, magnetic, electromagnetic, non-visible optical or photonic, thermal, chemical or electrical in nature.

35. The method of claim 34 wherein the energy-modifying contributes to handling, modulation or processing of a useful signal embodied in the energy.

36. A capacitor element capable of variable capacitance comprising:

first and second electrodes or their equivalents;

an intervening space for location of at least some disposed dielectric material;

the dielectric material comprising, at least in part, a variable dimension or shape droplet, bubble or film, said droplet, bubble or film material having a different dielectric constant than the ambient; and means for varying a dimension, shape or position of the droplet, bubble or film, thereby directly affecting the capacitance value of the capacitor as proportion of, volume of, area of or physical distribution of the dielectric material changes.

37. The capacitor element of claim 36 wherein a capacitive switch is provided for a purpose of switching or modulating an RF or other electromagnetic signal.

38. The capacitor element of claim 36 wherein instead of or in addition-to the dielectric material being size or shape variable an electrode formed by a bubble, droplet or film is size or shape variable thereby varying the area of the capacitive element.

39. The capacitor element of claim 36 wherein at least one of an RF or electromagnetic phase shifter, digital phase shifter, DTML (distributed MEMs transmission line), tunable filter, delay line, tunable resonator or reconfigurable antenna is provided.

40. An inkjet printer or other microfluidic patterning apparatus wherein a flow or motion of ink or patternable medium is at least one of switched, modulated or redirected by at least one disposed bubble, droplet or film of flowable material, wherein the bubble, droplet or film is not itself substantially emitted to or toward a paper or workpiece while doing so; and wherein the bubble, droplet or film is selectively disposable or formable in a position at or remote from an ink or medium emission orifice or aperture.

41. The printer or apparatus of claim 40 wherein the bubble, droplet or film is, at least in part, allowed to be emitted at any point in time regardless of its physical destination.

42. An inkjet or microfluidic printhead comprising:

at least one multiaperture or multiorifice emission portion;

an ink or emittable medium distribution means coupled to the at least one emission portion and its apertures;

at least one pulsed, pulsable or statically pressurized emitter section capable of pushing or squeezing ink or medium out of at least two of the apertures or orifices coupled to that particular emitter section at some point during operation; and bubble, droplet or film means for introducing or forming droplets, bubbles or films within or coupled to the ink;

wherein said bubble, droplet or film means are utilized to selectively block, modulate or allow the coupling of the local acoustic energy, pressure-waveform or static pressure available from the emitter section to particular orifices in that section;

wherein the droplet, bubble or film means thereby determine which apertures or orifices in that emitter section are active or coupled in terms of ink or medium-emission even while that emitter section continues to operate; and wherein the printhead has one or more such emitter sections and related orifices and the printhead can operate in at least one of drop-on-demand or continuous drop mode.

43. The printhead of claim 42 wherein multiple emitter sections each having their own orifices are provided, the emitter sections being at least one of:

a) individually driven transducers, b) individually driven piezotransducers, c) commonly driven transducers of any type, d) arrayed in one, two or three dimensions, e) supporting different colors or compositions of depositable medium.

44. An inkjet printer or other microfluidic patterning apparatus which can operate in either or both of a continuous-mode or drop-on-demand mode wherein:

in a continuous mode, streams, jets or droplets of patternable material or medium are emitted by a continuous wave (CW) or continuous operation of a pulser or transducer means, acoustic-shock producing means, pressure-pulse providing means, static pressurization means or other emitter means;

in a drop-on-demand mode, the emitter means may or may not also continuously pulse or apply static pressure but selected streams, jets or droplets from particular orifices are at least one of blocked, allowed or modulated on demand by a disposition of flowable bubbles, droplets or films which either interfere with or allow said emitter pulse or pressure to be coupled into selected orifices, or, alternatively, a rapid formation of disposed bubbles, droplets or films drive emission of the patternable material without substantial help from the emitter means;

the at least one emitter means possibly being common to two or more such selectable orifices; and the patterning apparatus having at least one emitter means and at least one orifice.

45. An inkjet printer or other microfluidic patterning apparatus which utilizes a shockwave or pressure pulse to encourage or cause ink or patternable-medium emission comprising:

a shockwave or pressure-pulse introducing means;

a body or reservoir of ink or medium and an ink or medium distribution means;

an aperture or orifice component out of which or from which ink or medium portions are emitted from one or more orifices;

the shockwave or pressure-pulse introducing means operable to directly or indirectly force ink or medium from at least one orifice; and bubble, droplet or film means capable of selectively forming or placing bubbles, droplets or films of a flowable material or fluid into or coupled to a path or body of said ink or medium;

wherein said bubble, droplet or film means favorably provides at least one of:

a) selective switching or modulation of ink or medium emission from at least one orifice, b) selective switching among multiple ink or medium types or multiple ink or medium sources, c) controlled mixing of different inks, ink colors or mediums, d) selective switching of electrical potential or current to a stream or jet of ink, ink portions, medium or medium portions, e) ink or medium portion velocity control or portion size control, f) portion emission-angle control, g) satellite droplet or satellite-portion control, h) inkjet or microfluidic-jet acoustic impedance or resonance control, and i) turning off or deactivation of defective or dirty orifices, regardless of whether the flowable bubble, droplet or film is ever emitted from the orifice in any form and regardless of whether the flowable bubble, droplet or film is composed of an ink, ink constituent, medium or medium constituent.

46. A device for modifying a source of energy with respect to at least one parameter comprising:

a member having an arrangement of two or more bubbles, droplets or films of a flowable material or liquid, at least some of which can be selectively changed with respect to a physical property or dimension;

a source of energy, at least a portion of which is incident upon or in energetic communication with the arrangement;

said arrangement capable of modifying a parameter of an incoming or communicated energy portion in a manner at least partly dependant upon a geometrical arrangement of the bubble or droplets or their physical properties; and the modified energy having a useful characteristic different than the incoming energy.

47. The device of claim 46 wherein the energy modification involves any one or more of diffraction, refraction, reflection, focusing, defocusing, polarization, attenuation, redirection, beam-splitting, beam-steering, beam-shape change, filtering or signal injection.

48. The device of claim 46 wherein said selective changing involves one or more of:

causing a variation in size or presence of one or more droplets, bubbles or films;

causing a variation in a physical, electronic, electromagnetic or optical property of one or more droplets, bubbles or films;

causing a variation in shape of one or more droplets, bubbles or films for any period;

having hardware or software communicate a desired change-pattern to said arrangement;

having hardware or software implement a change-pattern based on a state of the pre-treated energy or post-treated energy;

varying, at least on a statistical basis, a property of the arrangement;

applying a dynamic change-pattern to the arrangement, the pattern having a relationship to a predetermined or computed waveform;

changing the size or presence of at least one bubble, droplet or film via the use of thermal forces or forces induced by the application of a field or potential;

causing a known distribution of a parameter to be implemented upon the arrangement; or having the arrangement varied in accordance with feedback.

49. A device for modifying an ability to couple or propagate energy or the flow of energy between a first entity and a second entity comprising:

a first entity from which energy or an energy component is to be passed, transmitted or emitted from;

a second entity to which energy or an energy component is to be passed, transmitted or emitted to or into;

at least one intervening space between or among at least a portion of the first and second entities;

the at least one space filled or at least partly occupied with respect-to volume-fraction with a first material or a vacuum;

a second flowable material disposable as at least one or more droplets, bubbles or films into at least some of said at least one space;

a replacement or displacement of a first material or vacuum with the second material, at least in a portion of said at least one space, changing a propagation parameter for energy or an energy component to travel through or be coupled across said at least one space; and means to controllably effect said replacement.

50. The device of claim 49 wherein the propagation parameter is at least one of a reflection, refraction, transmissivity, reflectivity or attenuation coefficient, an impedance, a conductivity, a resistance, a dielectric property, a lossiness property, an RF parameter, an optical property or the height of an energy barrier.

51. The device of claim 49 wherein the space can be incrementally occupied by one or more disposed droplets or bubbles of the second material or by an incrementally disposed or sized wettable film.

52. The device of claim 49 wherein said replacement switches, modulates or redirects energy or energy-component propagation or energy-potential application in from one or both of a) from the first entity to or upon the second entity, b) from the second entity to or upon the first entity, or c) from both entities to each other.

53. The device of claim 49 wherein software or hardware gives instructions or data relating to a state, parameter of, or pattern of at least one droplet, bubble or film or pattern thereof which are present or which are to be implemented.

54. The device of claim 49 wherein said droplet, bubble or film second material disposed in the space includes at least one of:

a bubble of vapor or gas of the first material;

a bubble of a gas, air or plasma;

a vacuum;

a droplet or film of a formable or flowable liquid, cream, paste, gel, wax, oil, hydrocarbon-containing material, suspension, emulsion, or multiphase mixture;

a material native to the first or second entity, regardless of phase;

a solid, rigid or semirigid material, porous or non-porous;

a bubble, droplet or film which wets a surface; or a wetting or dewetting material.

55. The device of claim 49 wherein said first material in the space includes at least one of:

a gas or air;

a plasma;

a vacuum;

a droplet or film of a formable or flowable liquid, cream, paste, gel, wax, oil, hydrocarbon-containing material, suspension, emulsion, or multiphase mixture;

a material native to the first or second entity, regardless of phase;

a solid, rigid or semirigid material, porous or non-porous;

a wetting or dewetting material; or a permeable or porous material.

56. The device of claim 49 wherein the disposition of the second material, at least in part, is one permanent or temporary.

57. The device of claim 49 wherein the energy or energy component includes at least one of:

acoustic energy;

RF energy with a frequency measured in units of megahertz, gigahertz or terahertz;

optical energy;

microwave energy;

electrical energy as for flowable current or voltage which can be applied;

thermal energy;

infrared energy;

pneumatic or hydraulic energy kinetic or kinematic energy associated with mass-transport of a medium;

any polarized or unpolarized energy; or any directional or non directional energy.

58. The device of claim 49 wherein said modified ability includes at least one of:

changing the direction of a passing energy or energy component;

changing the ability of energy or an energy component to pass;

modulating a passing energy or energy component in any manner;

polarizing or depolarizing a passing energy or energy component;

filtering a passing energy or energy component;

adding to or impressing upon the passing energy or energy component a waveform or a new energy;

changing the amount of area across which an energy or energy component can pass;

changing the pattern of how the area across which an energy or energy component can pass is distributed;

reflecting, refracting, diffracting, redirecting, scattering, absorbing or attenuating some of the energy or a component of the energy as it passes from one entity to another;

controlling the reflectivity, impedance or resistance of energy or energy-component flow between entities;

modifying said ability in response to hardware or software sensing or computation; or converting an energy or energy-component from a first energy form to a second form such as from RF energy to heat.

59. An acoustic apparatus for forming, delivering or processing a beam of acoustical energy and having an ability to vary its acoustic aperture size comprising:

a source of an acoustic beam made available for a useful purpose;

an arrangement of flowable droplets, bubbles or films which are located at least partly in a path of the beam;

a presence or absence of the arrangement in the path determining a degree of coupling of at least an acoustic energy component of the beam along a portion of said path; and a controlled manipulation of the arrangement in terms of presence, absence or physical attributes providing a means to vary the acoustic aperture of the beam.

60. The apparatus of claim 59 wherein the apparatus is at least one of:

an ultrasonic imaging apparatus;

an ultrasonic therapy apparatus; and an ultrasonic sensor apparatus.

61. A method of forming a pattern or arrangement of one or more energy waveguides on or in a substrate comprising:

providing a substrate;

providing a droplet, bubble or film formation means;

operating the formation means to form droplets, bubbles or films in a pattern of one or more desired waveguides;

a droplet, bubble or film material being chosen such that at least one useful type of energy can be guided through said waveguides, the material providing the guiding action in combination with its arrangement; and one or more such droplets, bubbles or films possibly being physically merged to form the waveguide or waveguide arrangement.

62. The method of claim 61 wherein at least one of:

the waveguide comprises an elongated body of the material and the energy propagates inside the material body; and the waveguide comprises a channel or path substantially free of the material but is laterally defined by one or more bodies of the material, the energy propagating in the material-free waveguide defined by the adjacent material.

63. The method of claim 61 wherein an energy or energy component being guided includes at least one of: a) optical energy, b) electromagnetic energy, and c) acoustical energy.

* * * * *